US011022918B2

(12) United States Patent
Izawa

(10) Patent No.: US 11,022,918 B2
(45) Date of Patent: Jun. 1, 2021

(54) FIXING DEVICE WITH DETECTOR FOR CONVEYANCE OF RECORDING MEDIUM

(71) Applicant: HEWLETT-PACKARD DEVELOPMENT COMPANY, L.P., Spring, TX (US)

(72) Inventor: Tatsunori Izawa, Yokohama (JP)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/760,272

(22) PCT Filed: Oct. 12, 2018

(86) PCT No.: PCT/KR2018/012001
§ 371 (c)(1),
(2) Date: Apr. 29, 2020

(87) PCT Pub. No.: WO2019/088495
PCT Pub. Date: May 9, 2019

(65) Prior Publication Data

US 2020/0301324 A1 Sep. 24, 2020

(30) Foreign Application Priority Data

Oct. 31, 2017 (JP) ..... JP2017-210470

(51) Int. Cl.
*G03G 15/20* (2006.01)

(52) U.S. Cl.
CPC ..... *G03G 15/2028* (2013.01); *G03G 15/2035* (2013.01)

(58) Field of Classification Search
CPC ..... G03G 15/2028; G03G 15/2035; G03G 15/657; G03G 15/6573; G03G 15/6576
See application file for complete search history.

(56) References Cited

U.S. PATENT DOCUMENTS

2007/0177913 A1 8/2007 Russel et al.
2008/0101813 A1* 5/2008 Maul ..... G03G 15/2028 399/68

(Continued)

FOREIGN PATENT DOCUMENTS

JP 4854465 11/2011
JP 4873926 12/2011
JP 5117319 10/2012

*Primary Examiner* — Sandra Brase
(74) *Attorney, Agent, or Firm* — Staas & Halsey, LLP

(57) ABSTRACT

A fixing device includes a heating roller, a pressing roller, a detector and one or more corrective devices. The pressing roller conveys a recording medium at a nip portion formed by pressing against the heating roller and fixes an image formed on the recording medium with heat at the nip portion. A detector detects at least one of a passing region of a tip of the recording medium, an angle of the recording medium, and a degree of deformation of the recording medium from a direction of a side face of the paper P, in order to predict a malfunction in a conveyance of the recording medium. The corrective device(s) carry out a corrective operation associated with the conveyance of the recording medium, in response to the malfunction predicted, for example stopping or correcting the conveyance of the recording medium, in order to prevent the malfunction from occurring.

15 Claims, 8 Drawing Sheets

(56) References Cited

U.S. PATENT DOCUMENTS

| | | | | |
|---|---|---|---|---|
| 2008/0298859 | A1 | 12/2008 | Ueyama et al. | |
| 2011/0150548 | A1* | 6/2011 | Kasuga | G03G 15/6573 399/388 |
| 2014/0140746 | A1* | 5/2014 | Egawa | G03G 15/6576 399/406 |
| 2014/0219697 | A1 | 8/2014 | Murooka | |
| 2016/0018768 | A1 | 1/2016 | Kinouchi et al. | |
| 2016/0026140 | A1 | 1/2016 | Oomoto et al. | |

* cited by examiner

【Figure 1】
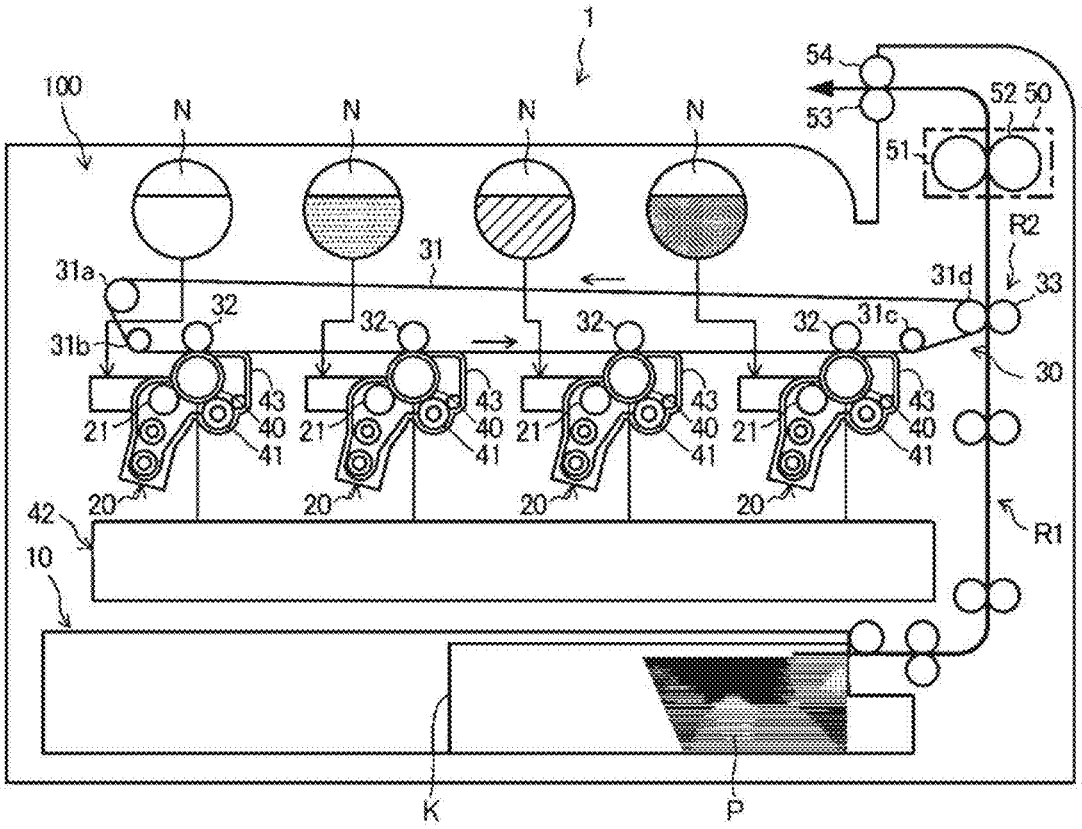

【Figure 2】
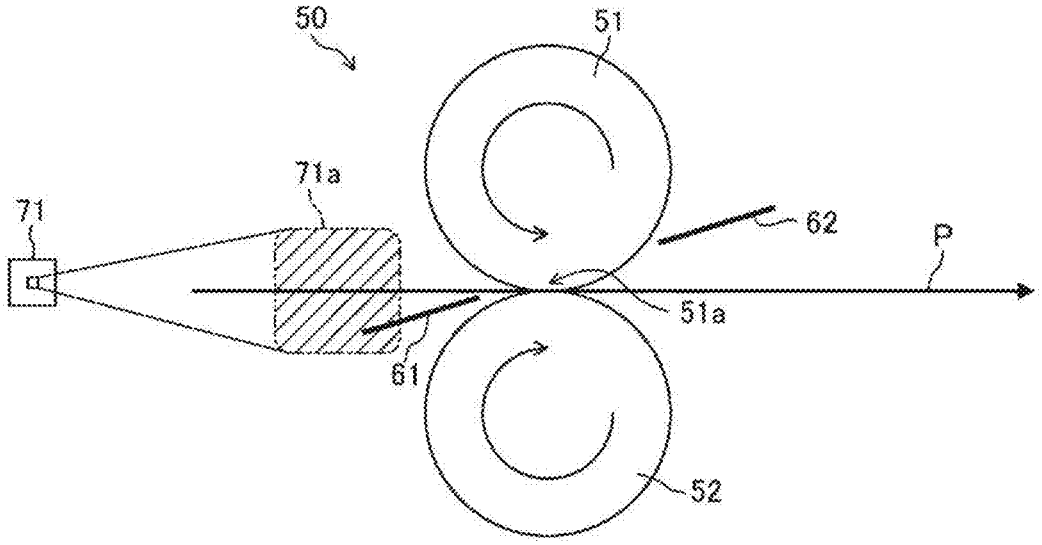
【Figure 3】
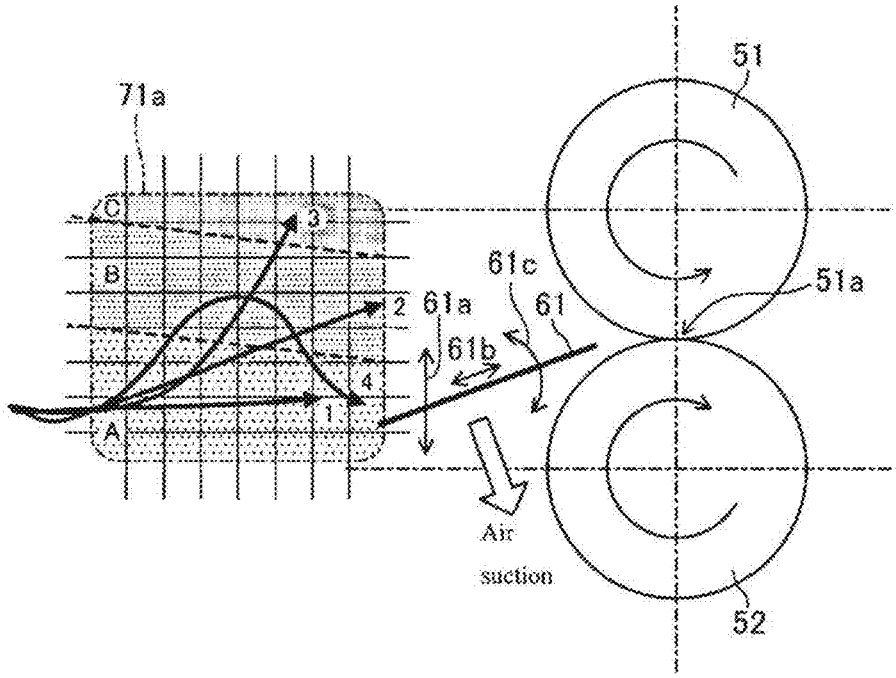

【Figure 4】
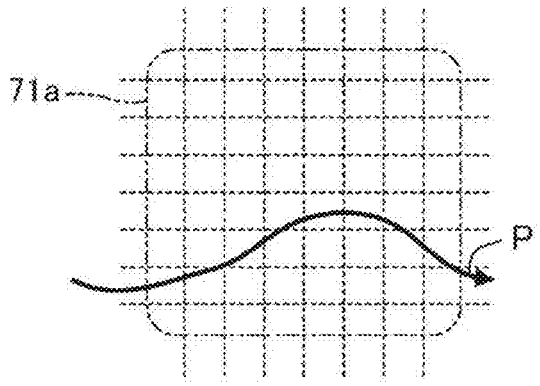
【Figure 5】
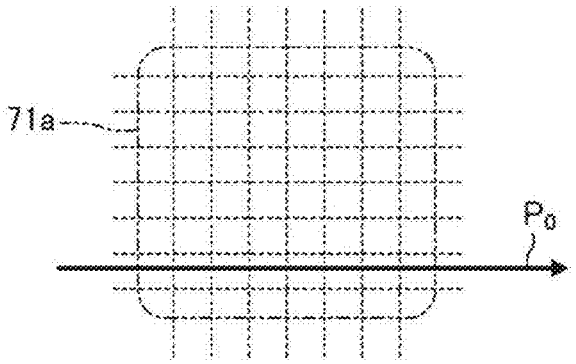

【Figure 6】
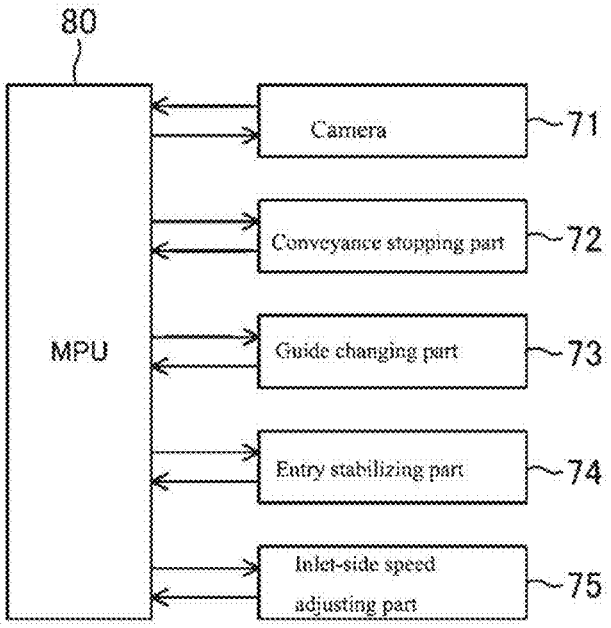
【Figure 7】
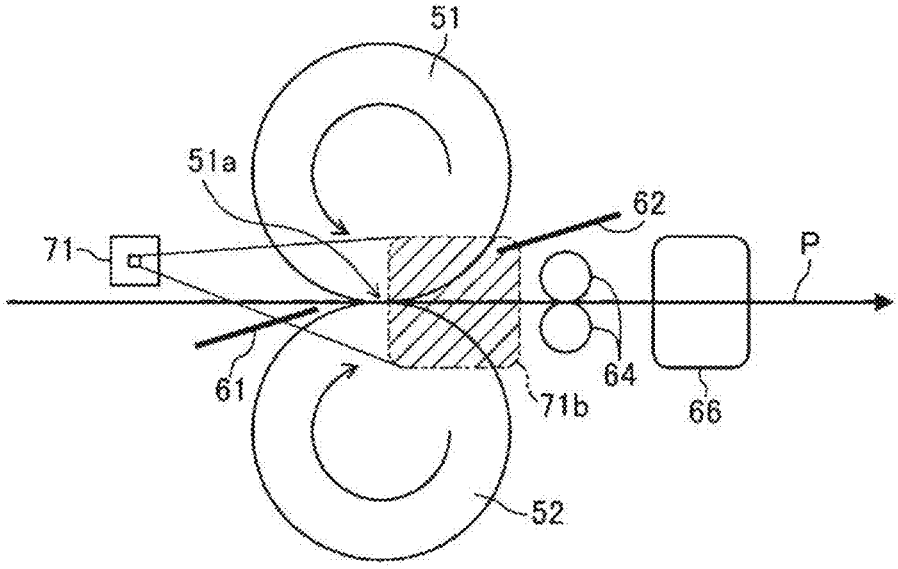

【Figure 8】
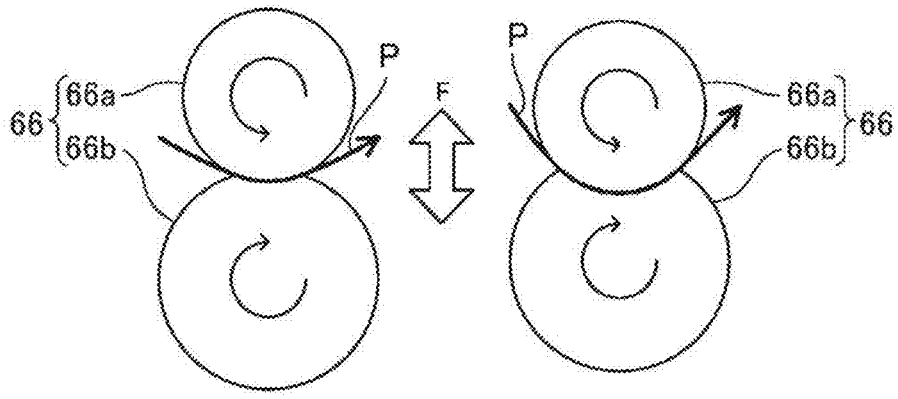
【Figure 9】
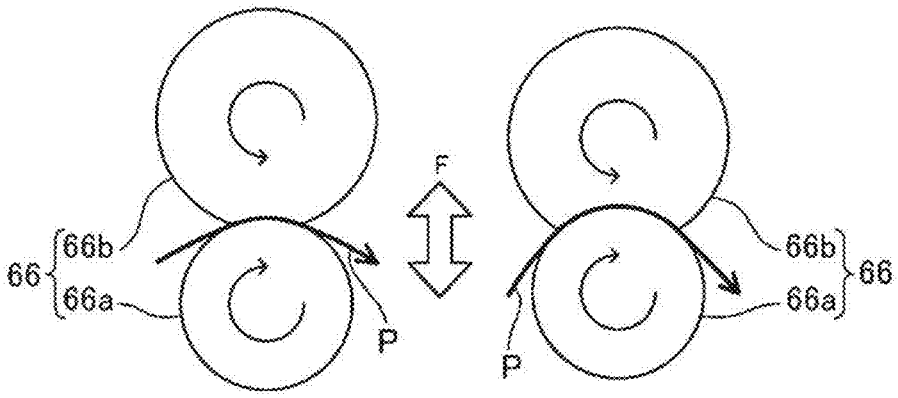

【Figure 10】
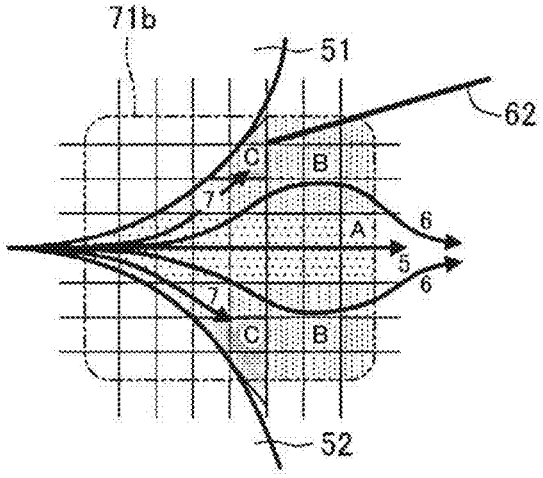
【Figure 11】
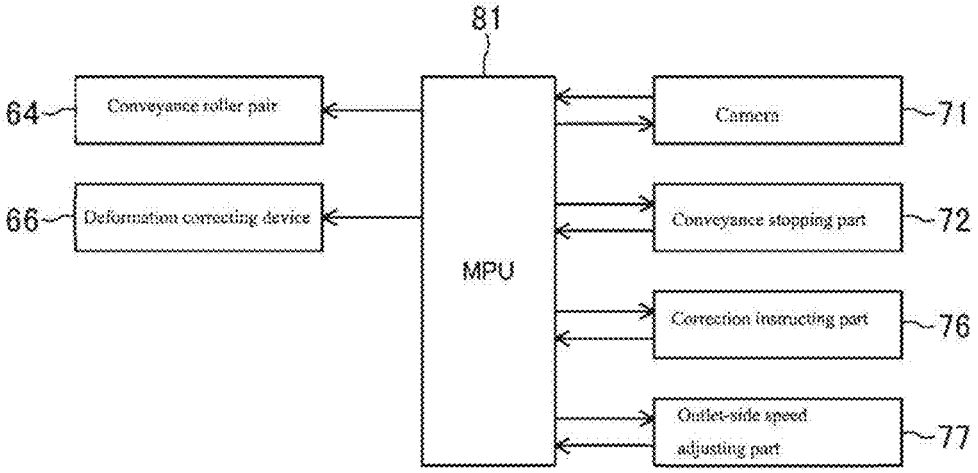

【Figure 12】
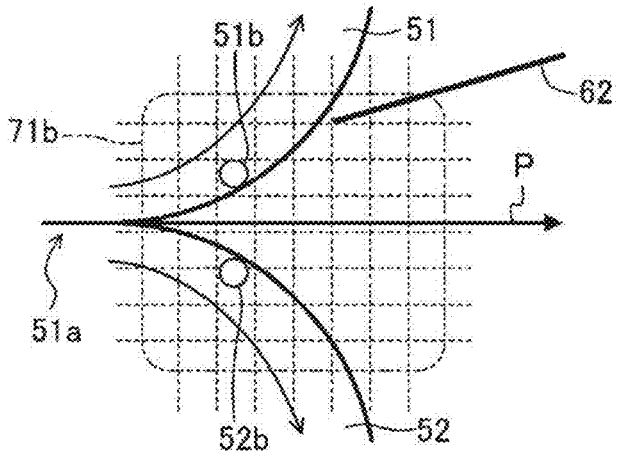
【Figure 13】
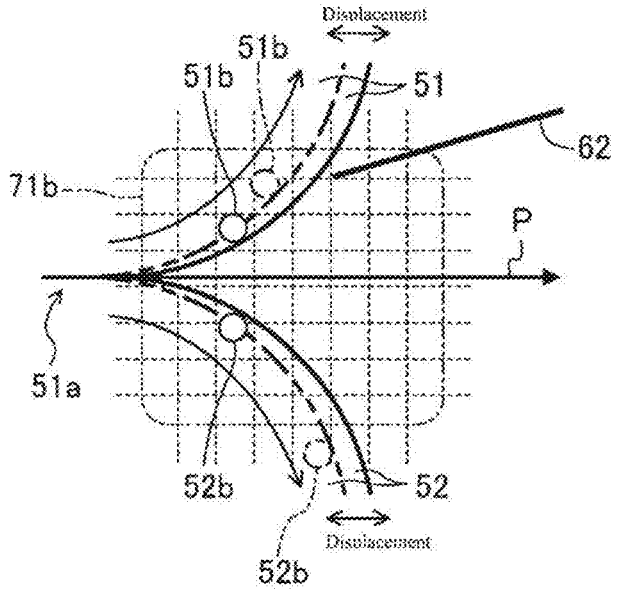

【Figure 14】
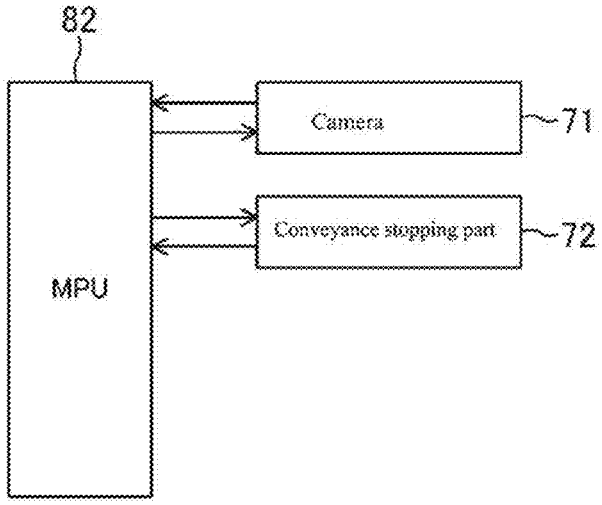

FIXING DEVICE WITH DETECTOR FOR CONVEYANCE OF RECORDING MEDIUM

CROSS REFERENCE TO RELATED APPLICATIONS

This application is a U.S. National Stage Application which claims the benefit under 35 U.S.C. § 371 of International Patent Application No. PCT/KR2018/012001 filed on Oct. 12, 2018, which claims foreign priority benefit under 35 U.S.C. § 119 of Japanese Patent Application No. 2017-210470 filed on Oct. 31, 2017, in the Japanese Intellectual Property Office, the contents of all of which are incorporated herein by reference.

BACKGROUND ART

Printers, copiers and facsimiles using an electrophotographic technology and multifunctional machines having these integrated therein are equipped with a fixing device for fixing toner on a recording medium such as paper by heat and pressure. A fixing device is provided with a heating rotation body for supplying heat for fusing toner to a recording medium, and a pressing rotation body for supplying a pressure for pressure bonding of toner to the recording medium. Toner that has been transferred onto the recording medium is fixed onto the recording medium while the recording medium is conveyed in a state where it is sandwiched at a nip portion, where the heating rotation body and the pressing rotation body are pressed against each other. At that time, in the fixing device, the recording medium to be conveyed varies its position and angle for entry to the nip portion depending on the use environment, and the kind (or type) and the state of the recording medium.

DESCRIPTION OF DRAWINGS

FIG. 1 is a schematic front view showing an example image forming apparatus including a fixing device according to an example.

FIG. 2 is a schematic side view showing the example fixing device shown in FIG. 1.

FIG. 3 a schematic side view showing an imaging region of an upstream side in conveyance (inlet-side) in the example fixing device of FIG. 2.

FIG. 4 is a schematic side view showing a recording medium, which passes through an inlet-side imaging region while being deformed (curled) in the example fixing device of FIG. 2.

FIG. 5 is a schematic side view showing a recording medium, which passes through the inlet-side imaging region in a normal state in the example fixing device of FIG. 2.

FIG. 6 is a block diagram showing one example of a functional block in the example fixing device shown in FIG. 2.

FIG. 7 is a schematic side view showing a fixing device according another example.

FIG. 8 is a schematic side view showing an operation of an example deformation correcting device (for correcting an upward curl), in the example fixing device shown in FIG. 7.

FIG. 9 is a schematic side view showing an operation of the example deformation correcting device (for correcting a downward curl), in the example fixing device shown in FIG. 7.

FIG. 10 is a schematic side view showing an imaging region of a downstream side in conveyance (outlet-side) in the example fixing device shown in FIG. 7.

FIG. 11 is a block diagram of the example fixing device shown in FIG. 7.

FIG. 12 is a schematic side view showing a state of a normal operation at an outlet-side imaging region of a fixing device according to another example.

FIG. 13 is a schematic side view showing a state where a malfunction occurs at the outlet-side imaging region of the example fixing device shown in FIG. 12.

FIG. 14 is a block diagram of the example fixing device shown in FIG. 12.

MODE FOR INVENTION

In the following description, with reference to the drawings, the same reference numbers are assigned to the same components or to similar components having the same function, and overlapping description is omitted.

FIG. 1 illustrates a schematic configuration (side configuration) of an example image forming apparatus (for example, printer) including an example fixing device.

Example Configuration of the Image Forming Apparatus

An image forming apparatus 1 is an apparatus forming a color image by use of each of colors such as magenta, yellow, cyan and black. As shown in FIG. 1, the image forming apparatus 1 includes an image forming part 100 and forms an image on a paper P (recording medium).

The image forming part 100 has a recording medium conveyance unit 10 for conveying a paper P, a developing device 20 for developing an electrostatic latent image, a transfer unit 30 for secondary transfer of a toner image on the paper P, a photoreceptor drum 40 being an electrostatic latent image carrier having an image formed on a periphery thereof, and a fixing device 50 for fixing the toner image on the paper P.

The recording medium conveyance unit 10 conveys the paper P, on which the image will be formed, on a conveyance path R1. Paper sheets P are stacked and accommodated in a cassette K, and picked up and conveyed one-by-one by a paper feeding roller.

The developing device 20 is provided for each of four colors. Each developing device 20 has a developing roller 21, which allows the photoreceptor drum 40 to carry toner. The developing device 20 makes such an adjustment that toner and a carrier are included at a desired mixing ratio, and further, they are mixed and stirred so that the toner is dispersed uniformly, thereby preparing a developer having an optimum charge amount imparted thereto. The developer is carried on the developing roller 21. Subsequently, when the developer is carried by the rotation of the developing roller 21 to a region facing the photoreceptor drum 40, toner of the developer carried by the developing roller 21 is moved onto an electrostatic latent image formed on the periphery of the photoreceptor drum 40 and the electrostatic latent image is developed.

The transfer unit 30 conveys a toner image formed by each developing device 20 to a secondary transfer region R2 where secondary transfer of the toner image is performed onto the paper P. The transfer unit 30 has a transfer belt 31, suspending rollers 31*a*, 31*b*, 31*c* and 31*d*, which are suspending the transfer belt 31, a primary transfer roller 32, which holds the transfer belt 31 together with the photoreceptor drum 40, and a secondary transfer roller 33, which holds the transfer belt 31 together with the suspending belt 31*d*. The transfer belt 31 is an endless belt, which moves in a circulating manner by the suspending rollers 31*a*, 31*b*, 31*c* and 31*d*.

The photoreceptor drum 40 is provided for each of four colors. Each photoreceptor drum 40 is provided along a moving direction of the transfer belt 31. The photoreceptor drum 40 has the developing device 20, a charging roller 41, an exposure unit 42 and a cleaning unit 43 provided thereon.

The charging roller 41 includes charging means that uniformly charges the surface of the photoreceptor drum 40 at a predetermined electric potential. The charging roller 41 moves while following the rotation of the photoreceptor drum 40. The exposure unit 42 exposes, to light, the surface of the photoreceptor drum 40, which has been charged by the charging roller 32, according to an image to be formed on the paper P. This changes an electric potential of a portion of the surface of the photoreceptor drum 40, which is exposed to light by the exposure unit 42, thereby forming an electrostatic latent image. Each of four developing devices 20 receives toner fed from a tonner tank N of each color, provided opposite to each developing device 20, and develops an electrostatic latent image formed on the photoreceptor drum 40 with the toner, thereby forming a toner image. After the toner image formed on the photoreceptor 40 is transferred to the transfer belt 31 through primary transfer, the cleaning unit 43 collects toner remaining on the photoreceptor drum 40.

The fixing device 50 adheres and fixes the toner image, which is transferred from the transfer belt 31 to the paper P through secondary transfer, to the paper P. The fixing device 50 has a heating roller (or fixing roller, or heating body) 51 for heating the paper P, and a pressing roller (or pressing body) 52 for pressing against the heating roller 51. The heating roller 51 is one example of a heating rotation body. The pressing roller 52 is one example of a pressing rotation body. The heating roller 51 and the pressing roller 52 are formed in a cylindrical shape or a rod-like shape. The heating roller 51 is sometimes provided with a heating source such as a halogen lamp or a heater in the interior thereof. There is provided a nip portion 51*a*, which is a contact region between the heating roller 51 and the pressing roller 52. The paper P is allowed to pass through the nip portion 51*a*, and this enables the toner image to be fused and fixed onto the paper P. After the secondary transfer of the toner image onto the paper P, toner remaining on the transfer belt 31 is collected by a belt cleaning device.

The image forming device 1 is provided with discharge rollers 53, 54 for discharging the paper P having the toner image fixed thereon by the fixing device 50 to the outside of the image forming device.

In some fixing devices, the recording medium to be conveyed varies its position and angle for entry to the nip portion depending on the use environment, and the kind (or type) and the state of the recording medium. Thus, some abnormal operation (e.g. paper winkle, image distortion and/or stains on images) and/or paper jams may occur in various conveyance systems. Further, if a recording medium winds around the heating rotation body or the pressing rotation body when it is discharged from the nip portion, a paper jam may occur, and further affect the material (or structural) condition of the heating rotation body, the pressing rotation body and/or other member(s) (or components).

Some fixing devices are configured to detect a paper jam caused in or around the fixing device by a recording medium passage sensor provided near an inlet of the fixing device and a recording medium passage sensor provided near an outlet of the fixing device. A detection method in such configurations is based on a transit time of the recording medium from the inlet to the outlet, and thus, a detection timing occurs later than a timing when a paper jam occurs, e.g. the paper jam is detected after it has occurred. As a result, the recording medium may wind around the heating rotation body or the pressing rotation body, which may interfere with the winding removal function. Further, depending on a state of the paper jam, the material (or structural) condition of the heating rotation body, the pressing rotation body and/or other member(s) (or components) may be affected.

In other fixing devices, the recording medium passage sensor provided near the inlet is replaced with a sensor capable of measuring a displacement of a recording medium such that the sensor detects a passing position (a distance from a guide member) and provides feedback to a conveyance motor and a conveyance guide. However, in this case, since the sensor detects the recording medium only at a specific point, an abnormal operation may still occur, resulting in a deformed (warped) recording medium, for example, which may further cause a paper jam and/or otherwise interfere with the normal conveyance of the recording medium.

In other configurations, when a recording medium has passed through first paper detection means after a paper jam is detected, there is a possibility that the paper is stopped where winding on a fixing roller and a pressing roller has occurred. If the rollers are moved in a reverse direction, the material (or structural) condition of the rollers may be affected.

In other configurations, a sensor at a downstream end does not detect paper, although a sensor at an upstream end detects the paper, and a paper jam only within a predetermined area is detected, thus causing a delay of detection. Therefore, when paper winds around a roller of a conveyance system, the wound paper must be removed from the roller.

In other configurations, only an amount of loop (bending) is detected, such that a deformation or the like of a recording medium cannot be detected.

An example fixing device is configured, at an upstream side of a nip portion: to stop conveyance of a recording medium depending on the passing region, the angle and the degree of deformation from a direction a side face of a tip of the recording medium during conveyance; or to stabilize the entry of the recording medium to the nip portion; or to adjust a speed of a conveyance motor for driving a rotation body.

Another example fixing device is configured, at a downstream side of the nip portion, depending on the passing region, the angle and the degree of deformation from a direction a side face of a tip of the recording medium during conveyance: to stop conveyance of a recording medium; or to correct the deformation of the recording medium; or to adjust a speed of conveyance means for conveying the recording medium downstream.

Another example fixing device is configured to detect a rotation speed, an action and a deformation state of a heating rotation body and a pressing rotation body from a direction of a side face of these rotation bodies.

Configuration of the Fixing Device

Example fixing devices will be described with reference to the drawings.

An example fixing device 50 is shown in FIGS. 2 to 6. FIG. 2 is a side view of the configuration of the fixing device 50. As described above, the heating roller 51 has a cylindrical shape or a rod-like shape.

When the heating roller 51 is formed of, for example, an endless belt as shown in FIG. 2, it may be formed of a base layer, an intermediate layer and a surface layer, ordered from the inside. For the base layer, a metal such as stainless or nickel can be used. For the intermediate layer, silicone rubber, for example, can be used. For the surface layer, a fluoro-resin, for example, can be used. This fluoro-resin makes it difficult to cause the paper P or a recording medium to be stuck. Further, when the heating roller 51 includes an endless belt, a nip portion forming-member made of, for example, a metal is sometimes disposed for forming the nip portion 51*a*. When the heating roller 51 is formed of a rod-like member, the heating roller 51 may be formed of, for example, a core metal at the inner portion thereof and an elastic body covering the outer periphery of the core metal. Further, when the heating roller 51 is a rod-like member, the heating source may have a form wherein a heating member using IH (induction heating) is a heat generation source or a form wherein heat is given indirectly from the outside.

The pressing roller 52 is provided so as to be in contact with the position where the nip portion 51*a* is formed on an outer periphery of the heating roller 51. The pressing roller 52 may be formed of, for example, a core metal at the inner portion and an elastic body covering the outer periphery of the core metal.

As described above, the pressing roller 52 drives the heating roller while holding the paper at the nip portion 51*a* on the outer periphery of the heating roller 51. At that time, the image electrostatically formed on the paper is fused and fixed by heat generated by the heating roller 51 and the pressure from the pressing roller 52 at the nip portion 51*a*.

Further, at an upstream side of the nip portion 51*a* in conveyance, or an inlet, there is provided an inlet guide plate 61 for guiding the paper P to the nip portion 51*a*. Likewise, at a downstream side of the nip portion 51*a* in conveyance, or an outlet, there is provided an outlet guide plate 62 for guiding the paper P to the downstream side in conveyance. The inlet guide plate (or guide member) 61 and the outlet guide plate (or guide member) 62 are examples of corrective devices in the example fixing device 50.

In addition, the fixing device 50 has detection means or a detector, for example a camera 71, which is provided at the inlet of the paper P at the nip portion 51*a*, and detects at least one of a passing region of a tip of the paper P, an angle of the paper P, and a deformation degree of the paper P from a direction of a side face of the paper P. The camera 71 may be, for example, a camera having an image sensor composed of a CCD (Charge Coupled Device) or a CMOS (Complementary Metal-Oxide Semiconductor) sensor. Further, the detection means is not limited to the camera 71, but may be a two-dimensional laser displacement meter (two-dimensional laser displacement sensor) or may be other two-dimensional displacement sensor.

As shown in FIG. 2, the camera 71 can capture an image of an inlet-side imaging region 71*a* positioned at the inlet of the nip portion 51*a*.

The example fixing device 50, is configured to determine a predictable malfunction in a conveyance of the recording medium. The predictable malfunction may be determined based on a detection of a passing region of a tip of the recording medium, on an angle of the recording medium and/or on a degree of deformation of the recording medium from a direction of a side face of the recording medium. The fixing device 50 further includes one or more corrective devices to carry out a corrective operation associated with the conveyance of the recording medium, in response to the predictable malfunction determined, in order to prevent the predictable malfunction from occurring.

Method for Controlling the Fixing Device/Determination of a Paper Jam

Hereafter, for methods for controlling the example fixing device, judgement (or determination) on paper jam will be described by referring the drawings. FIG. 3 shows a control map of an inlet-side imaging region 71*a* of the fixing device 50. The inlet-side imaging region 71*a* of FIG. 3 corresponds to the inlet-side imaging region 71*a* shown in FIG. 2.

As shown in FIG. 3, the inlet-side imaging region 71*a* is divided into three regions: a first passing region A, a second passing region B and a third passing region C.

For example, when the tip of the paper P passes through the first passing region A along a trajectory (1), it is determined that the paper P is in a normal conveyance state. Therefore, the fixing device 50 does not make any particular control on the paper P such as the above during conveyance.

When the tip of the paper P passes through the second passing region B along a trajectory (2), a guide changing part 73 (see FIG. 6) changes at least one of a height 61*a*, a position 61*b* and an angle 61*c* of the inlet guide plate 61. The guide changing part 73 may use an electric motor, an electromagnetic solenoid or the like as a driving device for driving the inlet guide plate 61. The guide changing part (or guide changing device) 73 is one example of guide changing means, among examples of corrective devices.

Further, for the paper P conveyed over the surface of the inlet guide plate 61, an entry stabilizing part (or entry stabilizing device) 74 (see FIG. 6) may be provided, which enables easy insertion of the tip of the paper into the nip portion 51*a*. In this case, the inlet guide plate 61 has a plurality of through holes provided in the front-back direction and air is sucked from under the inlet guide plate 61 at least during conveyance of the paper P. This allows the conveyed paper P to be pressed to the upper surface of the inlet guide plate 61. The entry stabilizing part (or entry stabilizing device) 74 is one example of entry stabilizing means.

Accordingly, when the tip of the paper P passes through the second passing region B, the guide changing part 73 adjusts at least one of the height 61*a*, the position 61*b* and the angle 61*c* of the tip of the paper P, and thereby, the tip of the paper P can be guided to the nip portion 51*a*. At that time, pressing the paper P to the upper surface of the inlet guide plate 61 by operation of the entry stabilizing part 74 allows the tip of the paper P to be more easily guided to the nip portion 51*a*.

It should be noted that the fixing device 50 does not necessarily have both of the guide changing part 73 and the entry stabilizing part 74, and it is effective to have either one of them.

Further, the entry stabilizing part 74 sucks air from under the inlet guide plate 61; however, instead of this, the entry stabilizing part may be configured so that air is discharged from above the inlet guide plate 61 to press the paper P to the upper surface of the inlet guide plate 61. In this case, the inlet guide plate 61 may be provided with through holes for air circulation, or not provided therewith.

When the tip of the paper P passes through the third passing region C along a trajectory (3), it is determined that the paper P cannot be conveyed; and a conveyance stopping part 72 (see FIG. 6) stops a conveyance motor (not illustrated), which drives the heating roller 51 or the pressing roller 52. A conveyance stopping part (or conveyance stopping device, also referred to herein as a roller stopping device) 72 is an example of a corrective device in the example fixing device 50.

When the tip of the paper P first passes through the second passing region B, and thereafter returns to the first passing region A, an inlet-side speed adjusting part 75 (see FIG. 6) increases a rotation speed of the conveyance motor to make up for a delay of feeding of the paper P. The inlet-side speed adjusting part (or speed adjusting device) 75 is an example of a corrective device in the example fixing device 50. When the paper P has a simple curl as shown in FIG. 4, the position of the tip of the paper P reaches later than that of paper $P_0$, which is flat and not curled as shown in FIG. 5. Therefore, if the rotation speed of the heating roller 51 and the pressing roller 52 is increased to correct the curl, the entire of the paper P is allowed to return to the first passing region A.

Even when the tip of the paper first passes through the second passing region B and then, returns to the first passing region A, the conveyance motor is stopped when it is determined that an event other than a simple deform (curl) has occurred, for example, a paper winkle generated on the paper P.

In some fixing devices, a recording medium passing sensor is provided near an inlet and an outlet of the device, but the determination of a paper jam is made by the recording medium passing sensor provided near the outlet. Accordingly, the fixing device is stopped after a paper jam has occurred in the fixing device.

In order to prevent the paper jam from occurring, the above-described fixing device 50 is enabled to stop conveying the paper P when it detects a state where occurrence of a paper jam of the conveyed paper P is predicted. In addition, when it is determined that the paper P that has not passed through a predetermined region can be inserted to the nip port ion 51*a* if it is corrected or remedied, it is possible to continue the operation of the fixing device 50.

Method for Controlling the Fixing Device/Failure Determination

Concerning methods for controlling the example fixing device, judgement (or determination) on a failure will be described.

Inlet-side detection data obtained from the inlet-side imaging region 71*a* in FIG. 3 is accumulated (or collected); and then, when the probability of a transition from the trajectory (1) to the trajectory (4) is increased (beyond a threshold, for example), an alarm is issued (or set off). Thereafter, even when an adjustment of the rotation speed of the conveyance motor does not enable passing of the first passing region A, it is determined that a failure occurs and the conveyance motor is stopped.

Further, when the behavior of conveyance of the paper P is not stable, for example, when the paper repeatedly moves between the first passing region A and the second passing region B or when the paper P has vibrations or flapping, it is determined that a failure occurs and the conveyance motor is stopped.

FIG. 6 shows one example of a functional block configuration in the example fixing device 50. As shown in FIG. 6, each of the above-described constituent elements can be controlled by, for example, a MPU (Micro Processor Unit) 80.

Another example fixing device will be described with reference to FIGS. 7 to 11. Identical signs (reference numbers) are given to the same constituent members and constituent elements as those described in the example fixing device shown in FIG. 2, and thus detailed explanations thereof are omitted.

FIG. 7 illustrates a side view of the configuration of the example fixing device. As shown in FIG. 7, the example fixing device 50 has detection means (or a detector), for example, a camera 71, which is provided at the outlet of the paper P at the nip portion 51*a*, and detects at least one of a passing region of a tip of the paper P, an angle of the paper P, and a deformation degree of the paper P from a direction of a side face of the paper P. The detect ion means is not limited to a camera, but may be a two-dimensional laser displacement meter (two-dimensional laser displacement sensor) or may be other two-dimensional displacement sensor.

As shown in FIG. 7, the camera 71 may capture an image of an outlet-side imaging region 71*b* positioned at the outlet of the nip portion 51*a*.

Further, provided at the downstream side of the heating roller 51 and the pressing roller 52 is a conveyance roller pair 64 for conveying the paper P having passed through the nip portion 51*a* and completed the fixing process. The conveyance roller pair 64 may have a configuration wherein a roller core thereof is made of a metal or a resin material and the surface of the roller core is coated with an elastic body. The conveyance roller pair (or conveyance device) 64 is one example of conveying means and an example of a corrective device in the example fixing device 50.

At the downstream side of the conveyance roller pair 64 in conveyance, a deformation correcting device (curl correcting device) 66 as deformation correcting means is provided. Applicable configurations for the deformation correcting device 66 include for example, a configuration using a conveyance roller pair, a configuration using three or more conveyance roller, and a configuration which suspends an endless belt. The deformation correcting device (curl correcting device) 66 is an example of a corrective device in the example fixing device 50.

FIGS. 8 and 9 show examples of the deformation correcting device 66, having a configuration including a pair of conveyance rollers.

The example deformation correcting device 66 of FIG. 8 is composed of, for example, a first roller 66*a* having a higher modulus of elasticity (hard) and a second roller 66*b*, which is in pressure contact with the first roller 66*a* and has a larger diameter and a lower modulus of elasticity (soft) than the first roller 66*a*. Further, the deforming correcting device 66 is provided so as to be able to adjust a pressing force F of each of rollers 66*a* and 66*b* depending on the degree of deformation of the paper P.

When an upward curl (projecting upwardly) occurs in the paper P having passed through the nip portion 51*a* and the conveyance roller pair 64, the pressing force F is controlled by an instruction from a correction instructing part 76 (see FIG. 11). As the degree of deformation of the paper P is larger, a larger pressing force is applied to correct an upward curl (the right-hand side of FIG. 8). The correction instructing part (correction instructing device) 76 is an example of a corrective device in the example fixing device 50.

The deformation correcting device 66 of FIG. 9 has the first roller 66*a* and the second roller 66*b*, whose places are changed therebetween relative to the deformation correcting device 66 of FIG. 8. When a downward curl (projecting downwardly) occurs in the paper P having passed through the nip portion 51*a* and the conveyance roller pair 64, this can correct the downward curl. In this case, as the degree of deformation of the paper P is larger, a larger pressing force is applied thereby to correct a downward curl (see the right-hand side of FIG. 9).

Method for Controlling the Fixing Device/Judgement on Paper Jam

Hereafter, for methods for controlling the example fixing device, judgement (or determination) on paper jam will be described by referring to the drawings. FIG. 10 shows a control map of an outlet-side imaging region 71*b* of the fixing device 50. The outlet-side imaging region 71*b* of FIG. 10 corresponds to the outlet-side imaging region 71*b* shown in FIG. 7.

As shown in FIG. 10, the outlet-side imaging region 71*b* is divided into three regions: a first passing region A, a second passing region B and a third passing region C.

For example, when the tip of the paper P passes through the first passing region A along a trajectory (5), it is determined that the paper P is in a normal conveyance state. Therefore, the fixing device 50 does not make any particular control on the paper P such as the above during conveyance.

When the tip of the paper P passes through the second passing region B along a trajectory (6), the speed of the conveyance roller pair 64 is increased by an instruction from an outlet-side speed adjusting part (see FIG. 11). Further, a correction amount for a curl, which may include an adjustment amount of a pressing force at the roller pair 64 is instructed (fed back) to the above-described deforming correcting device 66. The outlet-side speed adjusting part (or speed adjusting device) is an example of a corrective device in the example fixing device 50.

When the tip of the paper P passes through the third passing region C along a trajectory (7), it is determined that the paper P cannot be conveyed; and a conveyance stopping part 72 stops a conveyance motor (not illustrated), which drives the heating roller 51 or the pressing roller 52, and the conveyance roller pair 64. The conveyance stopping part (or conveyance stopping device) 72 is an example of a corrective device in the example fixing device 50

In some fixing devices, a recording medium passing sensor near an outlet of the device is used to detect a paper jam, which occurs in and around the fixing device.

The above-described example fixing device 50 stops conveying the paper P when it detects that a paper jam is predicted on the paper P having passed through the nip portion 51*a*. In addition, when it is determined that the paper P that has not passed through a predetermined region can be corrected or remedied, it is possible to continue the operation of the fixing device 50.

Method for Controlling the Fixing Device/Failure Determination

Concerning methods for controlling the example fixing device, judgement (or determination) on a failure will be described.

Outlet-side detection data obtained from the outlet-side imaging region 71*b* in FIG. 10 is accumulated (or collected); and then, when the probability for passage of the paper P through the third passing region C is increased (beyond a threshold, for example), it is determined that a failure occurs and the conveyance motor is stopped.

Further, when the behavior of conveyance of the paper P is not stable, for example, when the paper repeatedly moves between the first passing region A and the second passing region B or when the paper P has vibrations or flapping, it is determined that a failure occurs and the conveyance motor is stopped.

FIG. 11 shows one example of a functional block configuration in the fixing device 50. As shown in FIG. 11, each of the above-described constituent elements can be controlled by, for example, a MPU (micro Processor Unit) 81.

Further, in other examples, the fixing device may have the configuration shown in FIG. 11 combined with the configuration of the example shown in FIG. 6. This provides a configuration that allows paper jam detect ion and failure detection simultaneously at the inlet-side and outlet-side of the nip portion 51*a*.

An example fixing device will be described with reference to FIGS. 12 to 14.

In additional examples, reference is made to the configuration of the fixing device 50 shown in FIG. 7. However, for the example of FIG. 12, a camera 71 capable of image processing is suitable as detection means.

FIG. 12 illustrates an outlet-side imaging region 71*b* in the example fixing device. In FIG. 12, identical signs (or numeric references) are given to the same constituent members as those described in the example fixing device of FIGS. 7 to 11, and thus detailed explanations thereof are omitted.

As shown in FIG. 12, the heating roller 51 and the pressing roller 52 have detection marks 51*b* and 52*b* identifiable as side faces thereof given to circumferential portions of the side faces thereof. For example, the heating roller 51 and the pressing roller 52 have side faces that are marked with the detection marks 51*b* and 52*b* on circumferential portions of the side faces. These detection marks 51*b* and 52*b* may be formed by affixing a sealing material, painting or the like.

The camera 71 detects at least one of the rotation speed, the action and the deformation state of the heating roller 51 and the pressing roller 52, and the conveyance speed of the paper P.

These items (rotation speed, action, deformation state and conveyance speed) can be detected by making calculation based on image data captured by means of the camera 71.

Method for Controlling the Fixing Device/Failure Determination

Regarding a malfunction of the heating roller 51 and the pressing roller 52, also referred to as a first failure judgement (or first failure determination), it is determined that a failure occurs when a difference between the rotation speed of the heating roller 51 and the rotation speed of the pressing roller 52 as shown in FIG. 13, is equal to or greater than a threshold (e.g. a predetermined value). When it is determined that a failure occurs, the conveyance motor (not illustrated), which drives the heating roller 51 or the pressing roller 52, is stopped by an instruction from the conveyance stopping part 72 (see FIG. 14). The conveyance stopping part 72 is one example of rotation body stopping means. In the above, when the heating roller 51 and the pressing roller 52 have a difference of rotation speed of, for example, about 10% or more, it may be determined that a failure occurs.

Further, regarding a second failure judgement (or second failure determination), it is determined that a failure occurs when a difference between the rotation speed of the heating roller 51 or the pressing roller 52, and the conveyance speed of the paper P during conveyance is equal to or greater than a threshold (e.g. a predetermined value). When it is determined that a failure occurs, the conveyance motor, which drives the heating roller 51 or the pressing roller 52, is stopped by an instruction from the conveyance stopping part 72. For example, when the difference between the rotation speed of the heating roller 51 or the pressing roller 52, and the conveyance speed of the paper P becomes, for example, 10% or more, it may be determined that a failure occurs.

Further, regarding a third failure judgement (or third failure determination), it is determined that a failure occurs when the rotational trajectories of the heating roller 51 and the pressing roller 52 are changed beyond a threshold, e.g. the trajectories are changed by a predetermined value or more. When it is determined that a failure occurs, the conveyance motor, which drives the heating roller 51 or the pressing roller 52, is stopped by an instruction from the conveyance stopping part 72. For example, when a displacement amount between the rotational trajectories of the heating roller 51 and the pressing roller 52 becomes about 5% or more of the diameter (radius) of each of the rollers 51 and 52, it may be determined that a failure occurs.

The location of the configuration (detection mechanism) is not limited to the outlet-side of the nip portion 51*a*, but it may be provided at the inlet-side of the nip portion 51*a*.

FIG. 14 shows one example of a functional block configuration in the fixing device 50. As shown in FIG. 14, each of the above-described constituent elements can be controlled by, for example, a MPU (Micro Processor Unit) 82. Further, in some examples, the fixing device may have the configuration shown in FIG. 14 combined with the configuration of the example shown in FIG. 11.

The example fixing device detects at least one of the rotation speed, the action and the deformation state of the heating roller 51 and the pressing roller 52, and the conveyance speed of the paper P, thus enabling early and reliable detection of a failure caused by a malfunction of the heating roller 51 and the pressing roller 52.

Accordingly, a predictable malfunction such as a paper jam or deformation of a recording medium being conveyed, for example may be predicted, in order to carry out a corrective operation such as stopping or correcting the conveyance of the recording medium, in order to prevent the predictable malfunction from occurring. The operation of the device may thus be stopped by predicting a paper jam in advance, thereby better protecting the material (or structural) condition of constituent members (or components) of the device. Further, when the degree of deformation of a recording medium is small, the deformation may be corrected or remedied, thereby making it unnecessary to stop the operation of the device.

Various examples of fixing devices will be described.

An example fixing device includes a heating rotation body (or heating body), a pressing rotation body (or pressing body), detection means, and conveyance stopping means. The heating rotation body is provided with heating means. The pressing rotation body conveys a recording medium at a nip portion formed by pressing a peripheral side of the heating rotation body and fixes an image formed on the recording medium with heating at the nip portion. Detection means are provided at an upstream side of the nip portion in conveyance of the recording medium, to detect at least one of a passing region of a tip of the recording medium, an angle of the recording medium and a degree of deformation of the recording medium from a direction of a side face of the recording medium. Conveyance stopping means are adapted for stopping conveyance of the recording medium when the detection means detects that the recording medium is deviated from a predetermined region at the upstream side in conveyance.

When the detection means detects that the recording medium is deviated from a predetermined region at the upstream side in conveyance, the tip of the recording medium is less likely to be sandwiched at the nip portion and a paper jam is likely to occur. However, this example fixing device stops conveyance of the recording medium, and the device can be stopped before the occurrence of a paper jam. As a result, the material (or structural) condition of the rotation bodies and/or other member(s) are better protected.

Another example fixing device includes a heating rotation body, a heating rotation body, a pressing rotation body, detection means, a guide member, and guide changing means. The heating rotation body is provided with heating means. The pressing rotation body conveys a recording medium at a nip portion formed by pressing a peripheral side of the heating rotation body and fixes an image formed on the recording medium with heating at the nip portion. Detection means are provided at an upstream side of the nip portion in conveyance of the recording medium, to detect at least one of a passing region of a tip of the recording medium, an angle of the recording medium and a degree of deformation of the recording medium from a direction of a side face of the recording medium. A guide member is provided at the upstream side of the nip portion in conveyance, to guide the recording medium to the nip portion. The guide changing means are adapted to change at least one of a height, a position and an angle at the guide member when the detection means detects an abnormality in at least one of a passing region of a tip of the recording medium, an angle of the recording medium and a degree of deformation of the recording medium, or entry stabilizing means for stabilizing the entry of the recording medium to the nip portion.

Therefore, the guide changing means or the entry stabilizing means changes the position of the tip of the recording medium during conveyance to a position that allows the entry to the nip portion, thereby preventing a paper jam and reducing abnormal operation of the conveyance, and also making it unnecessary to stop the operation of the device.

Another example fixing device includes a heating rotation body, a pressing rotation body, detection means, and speed adjusting means. The heating rotation body is provided with heating means. The pressing rotation body conveys a recording medium at a nip portion formed by pressing a peripheral side of the heating rotation body and fixes an image formed on the recording medium with heating at the nip portion. The detection means are provided at an upstream side of the nip portion in conveyance of the recording medium, detect at least one of a passing region of a tip of the recording medium, an angle of the recording medium and a degree of deformation of the recording medium from a direction of a side face of the recording medium. The speed adjusting means are adapted to adjust a rotation speed of a conveyance motor when the detection means detects an abnormality in at least one of a passing region of a tip of the recording medium, an angle of the recording medium and a degree of deformation of the recording medium from a direction of a side face of the recording medium.

When it is assumed that a loop occurs due to a low conveyance speed of the tip of the recording medium (delayed arrival time to a predetermined position), an increase of rotation speed of the conveyance speed of the pressing rotation body can eliminate the loop of the recording medium after the passage through the nip portion. This can stabilize the behavior of the recording medium from the process prior to fixing and reduce abnormal operation of the conveyance, also making it unnecessary to stop the operation of the device.

Another example fixing device includes a heating rotation body, a pressing rotation body, detection means, and conveyance stopping means. The heating rotation body is provided with heating means. The pressing rotation body conveys a recording medium at a nip portion formed by pressing a peripheral side of the heating rotation body and fixes an image formed on the recording medium with heating at the nip portion. The detection means are provided at an upstream side of the nip portion in conveyance of the recording medium, to detect at least one of a passing region of a tip of the recording medium, an angle of the recording medium and a degree of deformation of the recording medium from a direction of a side face of the recording medium. The conveyance stopping means are adapted to stop conveyance of the recording medium when a conveyance region of the recording medium is within a predetermined region at the upstream side in conveyance and the detection means detects an abnormality in a conveyance speed of the recording medium.

Thus, the device can be stopped before the occurrence of a paper jam. As a result, the material (or structural) condition of the rotation bodies and/or other member(s) are better protected.

Another example fixing device includes a heating rotation body, a pressing rotation body, detection means, and conveyance stopping means. The heating rotation body provided with heating means. The pressing rotation body conveys a recording medium at a nip portion formed by pressing a peripheral side of the heating rotation body and fixes an image formed on the recording medium with heating at the nip portion. Detection means are provided at a downstream side of the nip portion in conveyance of the recording medium, to detect at least one of a passing region of a tip of the recording medium, an angle of the recording medium and a degree of deformation of the recording medium from a direction of a side face of the recording medium. Conveyance stopping means are adapted to stop conveyance of the recording medium when the detection means detects that the recording medium is deviated from a predetermined region at the downstream side in conveyance.

Therefore, when the detection means detects that the recording medium is deviated from a predetermined region at the downstream side in conveyance, the tip of the recording medium cannot be discharged from the fixing device and a paper jam is likely to occur. However, in this aspect, the conveyance stopping means stops conveyance of the recording medium, so the device can be stopped before the occurrence of a paper jam. As a result, the material (or structural) condition of the rotation bodies and/or other member(s) are better protected.

Another example fixing device includes a heating rotation body, a pressing rotation body, detection means, deformation correcting means, and correction instructing means. The heating rotation body is provided with heating means. The pressing rotation body conveys a recording medium at a nip portion formed by pressing a peripheral side of the heating rotation body and fixes an image formed on the recording medium with heating at the nip portion. The detection means are provided at a downstream side of the nip portion in conveyance of the recording medium, to detect at least one of a passing region of a tip of the recording medium, an angle of the recording medium and a degree of deformation of the recording medium from a direction of a side face of the recording medium. The deformation correcting means are provided at the downstream side of the nip portion in conveyance, to correct a deformation of the recording medium while conveying the recording medium downstream. The correction instructing means are adapted to instruct the deformation correcting means to correct a deformation of the recording medium when the detection means detects the deformation of the recording medium.

This allows the deformation correcting means to correct a deformation of a recording medium during conveyance, thereby preventing a paper jam and reducing abnormal operation of the conveyance, also making it unnecessary to stop the operation of the device.

Another example fixing device includes a heating rotation body, a pressing rotation body, detection means, conveyance means, and speed adjusting means. The heating rotation body is provided with heating means. The pressing rotation body conveys a recording medium at a nip portion formed by pressing a peripheral side of the heating rotation body and fixes an image formed on the recording medium with heating at the nip portion. The detection means are provided at a downstream side of the nip portion in conveyance of the recording medium, to detect at least one of a passing region of a tip of the recording medium, an angle of the recording medium and a degree of deformation of the recording medium from a direction of a side face of the recording medium. Conveyance means are provided at the downstream side of the nip portion in conveyance and conveys the recording medium downstream. The speed adjusting means are adapted to adjust a conveyance speed of the conveyance means when the detection means detects an abnormality in at least one of a passing region of a tip of the recording medium, an angle of the recording medium and a degree of deformation of the recording medium from a direction of a side face of the recording medium.

Accordingly, the behavior of the recording medium between the nip portion and the conveyance means at the downstream side thereof, may be stabilized, thereby reducing abnormal operation of the conveyance, and also making it unnecessary to stop the operation of the device.

Another example fixing device includes a heating rotation body, a pressing rotation body, detection means, and conveyance stopping means. The heating rotation body is provided with heating means. The pressing rotation body conveys a recording medium at a nip portion formed by pressing a peripheral side of the heating rotation body and fixes an image formed on the recording medium with heating at the nip portion. The detection means are provided at a downstream side of the nip portion in conveyance of the recording medium and detects at least one of a passing region of a tip of the recording medium, an angle of the recording medium and a degree of deformation of the recording medium from a direction of a side face of the recording medium. The conveyance stopping means are adapted to stop conveyance of the recording medium when a conveyance region of the recording medium is within a predetermined region at the downstream side in conveyance and the detection means detects an abnormality in a conveyance speed of the recording medium.

Accordingly, the fixing device can be stopped before the recording medium is discharged from the device. As a result, the rotation bodies and/or other member(s) are better protected, for example as to their material (or structural) condition.

Another example fixing device includes a heating rotation body, a pressing rotation body, and detection means. The heating rotation body is provided with heating means. The pressing rotation body conveys a recording medium at a nip port ion formed by pressing a peripheral side of the heating rotation body and fixes an image formed on the recording medium with heating at the nip portion. The detection means are provided at least a downstream side of the nip portion, of an upstream side and the downstream side thereof, in conveyance of the recording medium, to detect at least one of a rotation speed, an action and a deformation state of the heating rotation body and the pressing rotation body from a direction of a side face of the heating rotation body and the pressing rotation body.

Accordingly, when the detection means detects at least one of a rotation speed, an action and a deformation state of each rotation body, stoppage of the rotation body enables the device to be stopped before the occurrence of a paper jam.

As a result, the rotation bodies and/or other member(s) are better protected, for example as to their material (or structural) condition.

The detection means may further have rotation body stopping means for stopping a conveyance motor when a difference of rotation speed between the heating rotation body and the pressing rotation body exceeds a predetermined value.

The detection means may further have rotation body stopping means for stopping a conveyance motor when a difference between a rotation speed of the heating rotation body and the pressing rotation body, and a speed of the recording medium exceeds a predetermined value.

The detection means may further have rotation body stopping means for stopping a conveyance motor when a rotation trajectory of at least one of the heating rotation body and the pressing rotation body is deviated from a predetermined trajectory.

It is to be understood that not all aspects, advantages and features described herein may necessarily be achieved by, or included in, any one particular example. Indeed, having described and illustrated various examples herein, it should be apparent that other examples may be modified in arrangement and detail. An example fixing device will be described with reference to FIGS. 1 to 6 of the drawings.

LIST OF REFERENCE NUMBERS

50 Fixing device; 51 Heating roller (heating rotation body or heating body); 51*a* Nip portion; 52 Pressing roller (pressing rotation body of pressing body); 61 Inlet guide plate (guide member); 62 Outlet guide plate (guide member); 64 Conveyance roller pair; 66 Deformation correcting device (deformation correcting means or device); 66*a* First roller; 66*b* Second roller; 71 Camera (detection means or detector); 71*a* Inlet-side imaging region; 71*b* Outlet-side imaging region; 72 Conveyance stopping part (conveyance stopping means or device, rotation body stopping means or roller stopping device); 73 Guide changing part (guide changing means or device); 74 Entry stabilizing part (entry stabilizing means or device); 75 Inlet-side speed adjusting part (speed adjusting means or device); 76 Correction instructing part (correction instructing means or device); 77 Outlet-side speed adjusting part (speed adjusting means or device); P Paper (recording medium).

The invention claimed is:

1. A fixing device comprising:

a heating roller;

a pressing roller to convey a recording medium through a nip portion formed by pressing against the heating roller, the pressing roller to fix an image formed on the recording medium with heat, at the nip portion;

a detector to detect at least one of a passing region of a tip of the recording medium, an angle of the recording medium and a degree of deformation of the recording medium from a direction of a side face of the recording medium, associated with a malfunction in a conveyance of the recording medium; and at least one corrective device to carry out a corrective operation associated with the conveyance of the recording medium, in response to the malfunction predicted, to prevent the malfunction from occurring, the corrective operation including a first corrective operation when the detector is upstream of the nip portion and a second corrective operation when the detector is downstream of the nip portion.

2. The fixing device according to claim 1, wherein the detector is upstream of the nip portion, and wherein the at least one corrective device comprises:

a conveyance stopping device to stop the conveyance of the recording medium when the detector detects that the recording medium is deviated from a predetermined region upstream of the nip portion.

3. The fixing device according to claim 1, wherein the detector is upstream of the nip portion, and wherein the at least one corrective device comprises:

a guide member upstream of the nip portion, the guide member to guide the recording medium to the nip portion; and a guide changing device to change at least one of a height, a position and an angle of the guide member when the detector detects an abnormality in the at least one of the passing region of the tip of the recording medium, the angle of the recording medium and the degree of deformation of the recording medium, or an entry stabilizing device to stabilize the entry of the recording medium to the nip portion.

4. The fixing device according to claim 1, wherein the detector is upstream of the nip portion, and wherein the at least one corrective device comprises:

a speed adjusting device to adjust a rotation speed of a conveyance motor when the detector detects an abnormality in the at least one of the passing region of the tip of the recording medium, the angle of the recording medium and the degree of deformation of the recording medium.

5. The fixing device according to claim 1, wherein the detector is upstream of the nip portion, and wherein the at least one corrective device comprises:

a conveyance stopping device to stop the conveyance of the recording medium when a conveyance region of the recording medium is within a predetermined region upstream of the nip portion and the detector detects an abnormality in a conveyance speed of the recording medium.

6. The fixing device according to claim 1, wherein the detector is downstream of the nip portion, and wherein the at least one corrective device comprises:

a conveyance stopping device to stop the conveyance of the recording medium when the detector detects that the recording medium is deviated from a predetermined region downstream of the nip portion.

7. The fixing device according to claim 1, wherein the detector is downstream of the nip portion, and wherein the at least one corrective device comprises:

a deformation correcting device downstream of the nip portion, the deformation correcting device to correct a deformation of the recording medium while conveying the recording medium downstream; and a correction instructing device to instruct the deformation correcting device to correct a deformation of the recording medium when the detector detects the deformation of the recording medium.

8. The fixing device according to claim 1, wherein the detector is downstream of the nip portion, and wherein the at least one corrective device comprises:

a conveyance device downstream of the nip portion, the conveyance device to convey the recording medium downstream; and a speed adjusting device to adjust a conveyance speed of the conveyance device when the detector detects an abnormality in the at least one of the passing region of the tip of the recording medium, the angle of the recording medium and the degree of deformation of the recording medium.

9. The fixing device according to claim 1, wherein the detector is downstream of the nip portion, and wherein the at least one corrective device comprises:

a conveyance stopping device to stop the conveyance of the recording medium when a conveyance region of the recording medium is within a predetermined region downstream of the nip portion and the detector detects an abnormality in a conveyance speed of the recording medium.

10. A fixing device comprising:

a heating roller;

a pressing roller to convey a recording medium at a nip portion formed by pressing against the heating roller, the pressing roller to fix an image formed on the recording medium with heat at the nip portion; and a detector at least downstream of the nip portion in a conveyance of the recording medium, the detector to detect at least one of a rotation speed, an action and a deformation state of the heating roller and of the pressing roller from a direction of a side face of the heating roller and the pressing roller, the detector to determine the predictable malfunction based on the rotation speed of the heating roller and the rotation speed of the pressing roller.

11. The fixing device according to claim 10, wherein the at least one of the rotation speed, the action and the deformation state detected is associated with a predictable malfunction, the fixing device further comprising a roller stopping device to stop a conveyance motor when the predictable malfunction is determined.

12. The fixing device according to claim 11, the detector to determine the predictable malfunction when a difference between the rotation speed of the heating roller and the rotation speed of the pressing roller exceeds a predetermined value.

13. The fixing device according to claim 11, the detector to detect a conveyance speed of the recording medium, and the detector to determine the predictable malfunction when a difference between the rotation speed of the heating roller and the pressing roller, and the conveyance speed of the recording medium exceeds a predetermined value.

14. The fixing device according to claim 11, the detector to detect a rotation trajectory of the heating roller and of the pressing roller, and the detector to determine the predictable malfunction when the rotation trajectory of at least one of the heating roller and the pressing roller is deviated from a predetermined trajectory.

15. A fixing device comprising:

a heating member to heat a recording medium being conveyed;

a pressing member to fix an image formed on the recording medium, wherein a nip portion is defined where the pressing member presses the recording medium against the heating member;

a detector adjacent the nip portion, to determine a predictable malfunction in a conveyance of the recording medium through the nip portion; and at least one corrective device to carry out a corrective operation associated with the conveyance of the recording medium, to prevent the predictable malfunction from occurring, the corrective operation including a first corrective operation when the detector is upstream of the nip portion and a second corrective operation when the detector is downstream of the nip portion.

* * * * *